US008795094B2

(12) United States Patent
Ochi

(10) Patent No.: US 8,795,094 B2
(45) **Date of Patent: *Aug. 5, 2014**

(54) ROTATING AMUSEMENT APPARATUS

(75) Inventor: Yasushi Ochi, Kaizuka (JP)

(73) Assignee: BLD Oriental Co., Ltd., Izumisano, Osaka Prefecture (JP)

( * ) Notice: Subject to any disclaimer, the term of this patent is extended or adjusted under 35 U.S.C. 154(b) by 76 days.

This patent is subject to a terminal disclaimer.

(21) Appl. No.: 13/497,081

(22) PCT Filed: Apr. 21, 2010

(86) PCT No.: PCT/JP2010/002873

§ 371 (c)(1),
(2), (4) Date: May 22, 2012

(87) PCT Pub. No.: WO2011/058668

PCT Pub. Date: May 19, 2011

(65) Prior Publication Data

US 2012/0225728 A1 Sep. 6, 2012

(30) Foreign Application Priority Data

Nov. 13, 2009 (JP) ..... 2009-259841

(51) Int. Cl.
*A63H 13/20* (2006.01)
*A63G 1/38* (2006.01)
*A63G 1/10* (2006.01)

(52) U.S. Cl.
CPC ... *A63G 1/10* (2013.01); *A63G 1/38* (2013.01)
USPC ..... 472/6

(58) Field of Classification Search
USPC ..... 472/29, 6
See application file for complete search history.

(56) References Cited

U.S. PATENT DOCUMENTS

| | | | | |
|---|---|---|---|---|
| 2,819,899 | A * | 1/1958 | Thumberg | 472/39 |
| 3,661,386 | A * | 5/1972 | Green | 472/24 |
| 4,805,898 | A | 2/1989 | Jacober et al. | |
| 5,407,393 | A | 4/1995 | Schmidt | |

(Continued)

FOREIGN PATENT DOCUMENTS

| | | | |
|---|---|---|---|
| EP | 2058030 | A1 | 5/2009 |
| JP | 111677/1977 | U | 3/1979 |

(Continued)

OTHER PUBLICATIONS

International Search Report; Application No. PCT/JP2010/002877; Jun. 22, 2010; Japanese Patent Office.

(Continued)

*Primary Examiner* — Michael Dennis
(74) *Attorney, Agent, or Firm* — Stevens & Showalter, L.L.P.

(57) ABSTRACT

A rotating amusement apparatus 200 have a rotary device 100. The rotary device 100 of rotating amusement apparatus 200 of the present invention comprises a drive motor 110 placed on a base substance 110, a crank 112 and a rotating plate 115. And the crank 112 is pivotally supported by a rotating shaft rotated by the drive motor 110. a rotating plate 115 is fixed by the crank 112 rotating together with the crank 112. And a playgame member 210 is fixed in a rotating plate 115 of the rotary device 100, and the playgame member210 rotating together with the rotating plate 115, by eccentric rotation.

11 Claims, 10 Drawing Sheets

(56) References Cited

U.S. PATENT DOCUMENTS

| | | | |
|---|---|---|---|
| 6,582,315 | B1 | 6/2003 | Formanski |
| 8,608,582 | B2 | 12/2013 | Ochi |
| 2009/0012122 | A1 | 1/2009 | Branch et al. |
| 2010/0048310 | A1 | 2/2010 | Ochi |
| 2013/0090176 | A1 | 4/2013 | Ochi |
| 2013/0095935 | A1 | 4/2013 | Ochi |
| 2013/0133556 | A1 | 5/2013 | Ochi |

FOREIGN PATENT DOCUMENTS

| | | | | | |
|---|---|---|---|---|---|
| JP | 139254/1978 | U | | 4/1980 | |
| JP | 125903/1982 | U | | 4/1984 | |
| JP | 62-129072 | A | | 6/1987 | |
| JP | 73404/1989 | U | | 2/1991 | |
| JP | 4-15989 | U | | 2/1992 | |
| JP | H07-098782 | | | 4/1995 | |
| JP | 7-265548 | A | | 10/1995 | |
| JP | 8-38649 | A | | 2/1996 | |
| JP | 8-211330 | A | | 8/1996 | |
| JP | H08-196747 | | | 8/1996 | |
| JP | 8-229244 | A | | 9/1996 | |
| JP | 2009108449 | A | | 4/1997 | |
| JP | H11-299635 | | | 11/1999 | |
| JP | 2000-116959 | A | | 4/2000 | |
| JP | 2000167254 | | | 6/2000 | |
| JP | 2000197715 | | | 7/2000 | |
| JP | 2001-169864 | A | | 6/2001 | |
| JP | 2004-208844 | A | | 7/2004 | |
| JP | 2005-52305 | A | | 3/2005 | |
| JP | 2005-131215 | A | | 5/2005 | |
| JP | 2008067741 | A | | 3/2008 | |
| JP | 2008073497 | A | | 4/2008 | |
| JP | 2008536082 | A | | 9/2008 | |
| JP | 2008231904 | A | | 10/2008 | |
| JP | 200911421 | A | | 1/2009 | |
| WO | 2006025108 | A1 | | 3/2006 | |
| WO | WO2008/032687 | | * | 3/2008 | ..... A63G 1/08 |

OTHER PUBLICATIONS

Naoki Turuoka; Written Opinion of the International Searching Authority; Application No. PCT/JP2010/002877; Jun. 22, 2010; Japanese Patent Office.

Ochi, Yasushi; U.S. Appl. No. 13/497,070; Apr. 21, 2010 I.A. Date; entitled Tree-Shaped Decoration Apparatus.

Ochi, Yasushi; U.S. Appl. No. 13/497,085; Apr. 21, 2010 I.A. Date; entitled Slide Device.

Ochi, Yasushi; U.S. Appl. No. 13/497,116; Apr. 21, 2010 I.A. Date; entitled Rocking Play Device.

Ochi, Yasushi; U.S. Appl. No. 13/497,095; Apr. 21, 2010 I.A. Date; entitled Amusement Apparatus.

Ochi, Yasushi; U.S. Appl. No. 13/497,102; Apr, 21, 2010 I.A. Date; entitled Amusement Apparatus.

International Search Report; Application No. PCT/JP2010/002878; May 25, 2010; Japanese Patent Office.

Yosiaki Usui; Written Opinion of the International Searching Authority; Application No. PCT/JP2010/002878; May 25, 2010; Japanese Patent Office.

International Search Report; Application No. PCT/JP2010/002875; Jun. 1, 2010; Japanese Patent Office.

International Search Report; Application No. PCT/JP2010/002873; Jun. 8, 2010; Japanese Patent Office.

Tamotu Sakaii; Written Opinion of the International Searching Authority; Application No. PCT/JP2010/002873; Jun. 8, 2010; Japanese Patent Office.

International Search Report; Application No. PCT/JP2010/002872; Jun. 1, 2010; Japanese Patent Office.

Makoto Suzuki; Written Opinion of the International Searching Authority; Application No. PCT/JP2010/002872; Jun. 1, 2010; Japanese Patent Office.

International Search Report; Application No. PCT/JP2010/002876; Jul. 6, 2010; Japanese Patent Office.

Tuneaki Oota; Written Opinion of the International Searching Authority; Application No. PCT/JP2010/002876; Jul. 6, 2010; Japanese Patent Office.

* cited by examiner (A)

(B)

(A)

(B)

(A)

(B)

ROTATING AMUSEMENT APPARATUS

TECHNICAL FIELD

This invention relates to an amusement apparatus, and, in particular, to a rotating amusement apparatus comprising a rotary device for enabling the action that a user feels unexpectedly.

BACKGROUND ART

Currently, playground apparatus provided with a function with various movement is developed, for example, a ride-on amusement apparatus (hereinafter called the play apparatus) is installed in a supermarket or a department store. The ride-on amusement apparatus is swung or rotated by feeding a coin into the slot, and it is known to include the example disclosed in Japanese Unexamined Pat. App. Pub. No. H07-098782.

SUMMARY OF THE INVENTION

As for the playground equipment described in the prior art, the movement is limited to normal rotation or swing, and thus the ride-on amusement apparatus does not work so that a user using the play apparatus is surprised. Playground equipment having such movement usually requires a complicated control needs specialized knowledge and a craftsman-like sense to construct control panels. Therefore, a handling to change connection of the control line is necessary for maintenance such as repair and change, and thus great labor is required. In addition, it is necessary to maintain the playground equipment frequently to secure safety, and therefore the playground equipment cannot be provided with a mechanism required by the complicated control.

On the other hand, there is a lot of demand for playground equipment having unexpected movement. Therefore playground equipment enabling such movement by simple configuration, comprising a mechanism with excellent ability of maintenance such as repair and change, is desired. An object of the present invention, brought about in view of the circumstance described above, is to make available playground equipment performing unexpected movement by simple configuration.

Means for Resolving the Problem

This Invention to achieve the object is a rotating amusement apparatus having a rotary device comprising a drive motor placed on a base, a crank and a rotating plate. The crank is pivotally supported by a rotating shaft rotated by the drive motor. A rotating plate is fixed to the crank and rotates together with the crank. And a playgame member is fixed to the rotating plate of the rotary device, and the playgame member rotates together with the rotating plate, by eccentric rotation.

In accordance with an aspect of the present invention, when the rotating shaft rotates by the drive motor, the rotating plate will make eccentric rotation (rotating around the position within the specified distance from the center of the rotating plate), by fixing the rotating plate to the rotating shaft of the drive motor via the crank. And, the rotating plate makes the movement that a user does not expect by rotating around the position secured by the crank. The playgame member fixed to the rotary device is preferable in any configuration, and any playgame member can make eccentric rotation and can make further complicated movement. When a slanted rotating plate is used, the distances from the undersurface of the rotating plate to a floor are different, and thus it is preferable to fix a wheel to the rotating plate undersurface via an adjustment member to equate the height to a floor. The height of adjustment member is determined depending on the position where a wheel is placed.

In accordance with an aspect of the present invention, the crank may comprise a support horizontally supporting the rotating plate, and a fixture pivotally supporting the support to the rotating shaft. The rotating plate may be inclined against a horizontal-plane by being pivotally supported to the rotating shaft. Thus, the rotating plate makes eccentric rotation with the inclined condition by being pivotally supported to the rotating shaft, being inclined against a horizontal-plane.

In accordance with an aspect of the present invention, a urethane member and a gum resin function as a shock absorber for playground equipment safety. A gum resin is applied to the urethane surface coated on a part of a playgame member. In accordance with an aspect of the present invention, a playground equipment portion can be turned more easily by a wheel provided to the rotating plate.

In accordance with an aspect of the present invention, the rotating plate rotates further easily by hanging the rotating plate of the rotary device to a substantially reverse U-shaped frame vertically arranged on the base of the rotary device. Also a regulation means may be placed between the base of the rotary device and the rotating plate, for regulating an auto-rotation of the rotating plate. The rotating plate rotates while rotating on the rotating shaft of drive motor, and thus even if a room to install the rotating amusement apparatus is not wide enough, the rotating amusement apparatus to limit the auto-rotation of the rotating plate may be provided by a regulation means for regulating the auto-rotation of the rotating plate.

The playgame member comprises a support base placed on an upper part of the rotating plate, and comprises a plurality of holding members hung from the support base, which is turned by the rotation of the rotating plate. Also the rotating amusement apparatus comprises a frame placed on a top surface of the rotating plate for forming a game region for a user, partitioned off from the external space, and comprises a floor member comprising one or a plurality of members dividing the game region in the space into at least two spaces. And, the floor member forms a communication portion communicating with spaces vertically adjoining.

The rotating amusement apparatus comprising a swing apparatus placed on the rotating plate may be configured. The swing apparatus is provided with a lower rotating shaft pivotally provided in the lower frame, with a swing member, and with a lower frame. The swing member is fixed to the lower rotating shaft. And, an upper rotating shaft is rotatably provided to the swing member. The swing plate is fixed to the upper rotating shaft. Also the upper frame is fixed to the swing plate, and the upper frame is capable of swinging up and down by a motor.

A swing member is capable of swinging relative to the lower rotating shaft by a swing member being fixed to the lower rotating shaft. Also a swing member is capable of swinging relative to the upper rotating shaft by a swing member being fixed to the upper rotating shaft. Therefore, the upper frame fixed to the swing plate can configure the swing apparatus capable of swinging back and forth and around.

Effects of the Invention

According to the rotating amusement apparatus of the present invention, a rotating plate of the rotating amusement apparatus can make eccentric rotation by attaching a crank to a drive motor, and attaching one end of the crank to the rotating plate. Also by rotating around the position secured by the crank, the rotating amusement apparatus can make complicated swing operation by simple configuration. Therefore, a playground equipment having the movement that user does not expect and having an excellent ability of maintenance can be provided.

Also by the regulation means to connect the base and rotating plate, the auto-rotation of the rotating plate can be regulated, and thus depending on a room installing the playground equipment, movement of the playground equipment can be controlled.

DESCRIPTION OF THE PREFERRED EMBODIMENT

Detailed Description of the Preferred Embodiment 1

Figure 1:
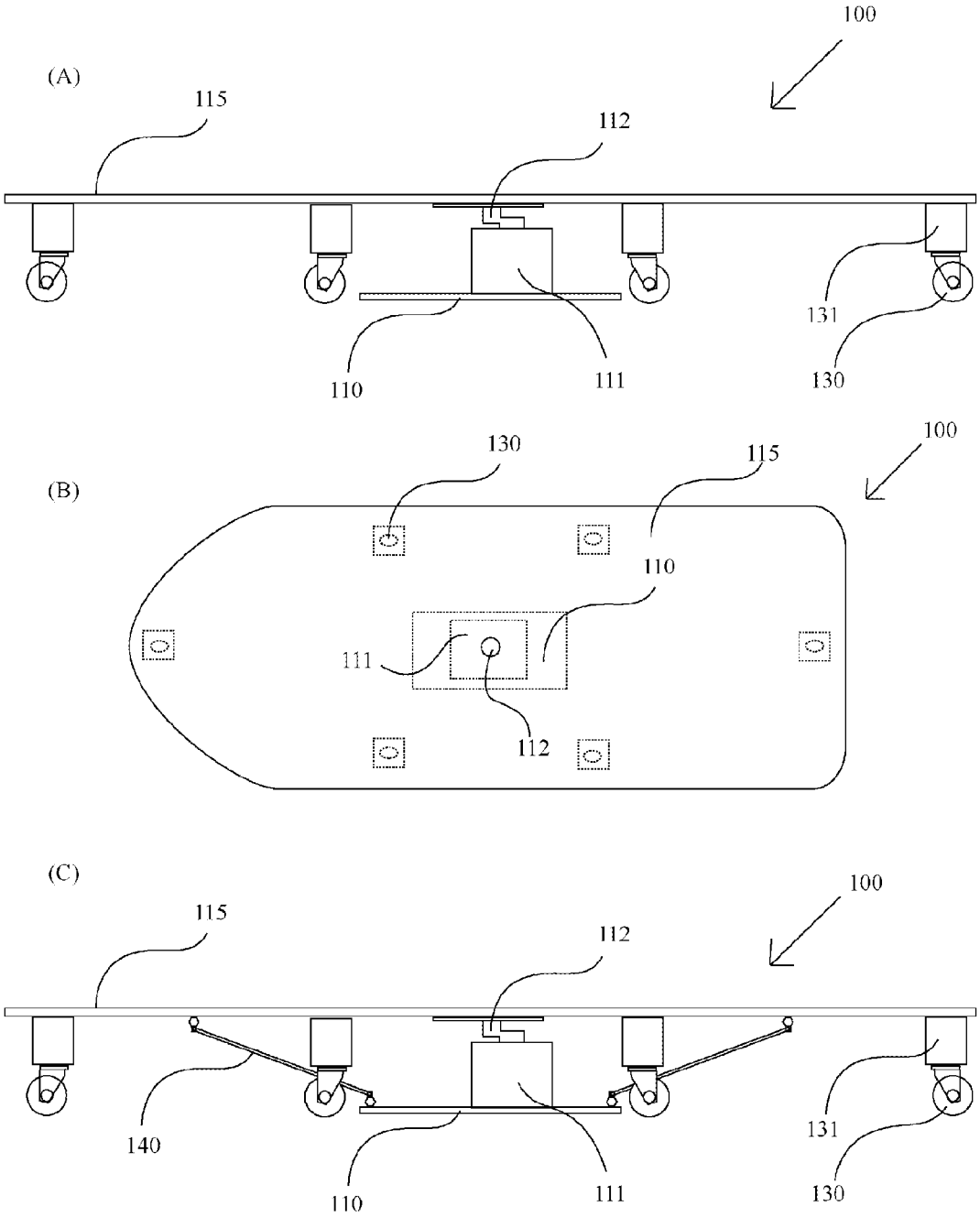
FIG. 1 is a top view and side elevation view illustrating an outlined configuration of a rotary device involving an embodiment of the present invention.

A specified embodiment of a rotary device 100 for rotating a rotating amusement apparatus 200 of this Invention is explained hereinafter with reference to the accompanying drawings. FIG. 1 is a schematic view of a rotary device 100 of this Invention. However, the details of parts which do not directly-relate to the present invention will be omitted. A playground equipment making eccentric rotation around a specified rotating shaft can be configured by associating the rotary device 100 of this Invention with a desired playground equipment (hereinafter a structure attached to the rotary device 100 is referred to as playgame member 210).

As shown in FIG. 1 (A), the rotary device 100 of this Invention is provided with a drive motor 111 as a driving means, and with a shaft shifting means (e.g., crank 112) comprising a handle connected to a rotating shaft, connecting another shaft shifted to a prescribed distance from the rotating shaft. At first, a drive motor 111 is placed on a base 110 (if a motor 111 and an after-mentioned elastic body are placeable, any shaped is preferable). The shaft shifting means (crank 112) is attached to the rotating shaft of the drive motor 111, and the rotating shaft of the drive motor is displaced within a specified range.

One end of the crank 112 rotates on a shaft same as the rotating shaft of the drive motor 111, and the other end of crank 112 makes eccentric rotation around the rotating shaft. Of course, a switch (not shown) for operating the drive motor 111 is provided to the rotary device 100. A rotating speed of the drive motor 111 may be configured to be controllable by the switch.

Also an overload protection means (e.g., torque limiter), not illustrated, for protecting the over load of the drive motor 111 may be attached to the rotating shaft of the drive motor 111, or to the crank 112.

The playgame member 210 imitating yachts is placed on the upper part of the drive motor 111 as will hereinafter be described. Therefore the weight of a user expecting to play with the rotating amusement apparatus 200 of this Invention is added to the drive motor 111. If the load added to the drive motor 111 is greater than a predetermined value, the overload protection means detects the load, and idles the drive motor 111. Then, a rotating plate 115 (described below) fixed by the crank terminates the autorotation of drive motor 111. The playgame member can be moved rotatable (hand-operated rotation) to the user's desired direction.

As described above, one end of the crank 112 is attached to the rotating shaft of the drive motor 111. The rotating plate 115 is attached to the other end of the crank 112. The rotating plate 115 with any shape is used if the playgame member 210 can be attached, and a rotating plate 115 having many kinds of shapes such as rectangular, polygon, circle or the like, can be attached. As in the preferred embodiment (cf. FIG. 1 (B)), the rotating plate 115 with a similar configuration of the base (described below) of the playgame member 210 attached to rotary device 100 can be used.

Figure 2:
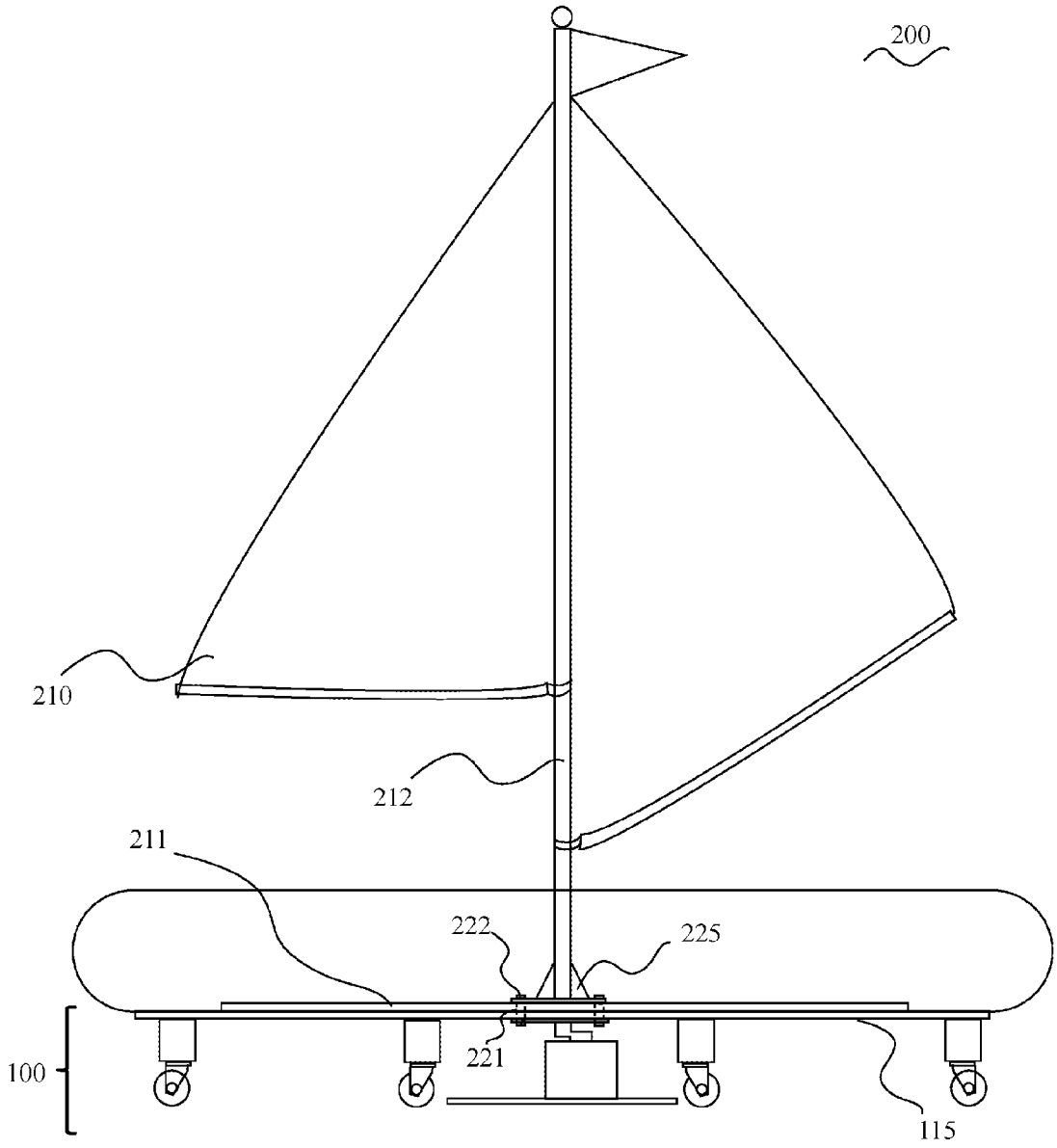
FIG. 2 is a side elevation view illustrating an example of a rotating amusement apparatus having a rotary device in accordance with an embodiment of the present invention.

As shown in FIG. 2, a playgame base 211 is fixed to the upper part of the rotating plate 115 as the base of playgame member 210. In the present embodiment, it is fixed by bolts 221 and nuts 222. The rotation of the crank by the motor causes the rotation of the playgame base by fixing the playgame base 211 to the rotating plate 115.

Wheels 130 are put on the lower part of the rotating plate 115. The wheels 130 are put on symmetrically with each other in top-view. In the present embodiment, as shown in FIG. 1 (B), one pair of wheels is put on before and behind the rotating plate 115 and two pairs of wheels are put on both sides of the rotating plate 115, so that six wheels are put on the rotating plate 115. A height adjusting means 131 for adjusting the height of a wheel 130 may be further provided. The rotating plate 115 makes eccentric rotation around via the crank 112 which was attached to the rotating shaft of the drive motor 111 when drive motor 111 operates (it is meant that it rotates in the conditions where rotating shaft slipped off). When the drive motor 111 operates, the rotating plate 115 makes eccentric rotation via the crank 112 attached to the rotating shaft of the drive motor 111 (mean rotating with rotating shaft displaced within a specified range). At this time, the rotating plate 115 rotates while rotating on the rotating shaft of the drive motor 111. The rotating velocity of this rotating plate 115 is not constant, and thus the rotating plate 115 rotates in an unexpected velocity. Therefore, as will hereinafter be described, when the playgame member 210 is fixed to the rotating plate 115, the playgame member 210 works to a user unexpectedly.

A specified shock absorber is coated to the rotating amusement apparatus 200 of the present invention. A foam such as urethane is coated to the outer frame of the rotating amusement apparatus 200 as this shock absorber. For example, the one side face of the shock absorber of a hollow cylinder is cut, so as to be coatable on the stick face. And the shock absorber having been coated on a part of the rotating amusement apparatus 200 (even all surfaces of the apparatus is preferable and may be the part that it is expected that a user comes in contact with), and, a gum resin having been painted on the surface of the shock absorber, as a result of that a surface of the shock absorber has a water repellency. Of course the side (cut part) of the shock absorber will be closed when gum resin is painted. The shock absorber may be a composition other than urethane, and shock absorber like foams such as polyethylene is preferably used.

A regulation means 140 for regulating the auto-rotation of the rotating plate 115 can be provided. An elastic body (rubber or a spring are preferably used) connecting between the base 110 supporting the drive motor 111 and the rotating plate 115 is used as the regulation means 140. If the regulation means 140 can be configured to regulate auto-rotation of the rotating plate 115, any alignment method thereof is preferable. In accordance with exemplary embodiments, as shown in FIG. 1 (C), the regulation means 140 is placed slopewise from near the end of base 110 to the undersurface of the rotating plate 115. As another configuration, the regulation means 140 is orthogonally-placed from near the end of the base 110 to the undersurface of the rotating plate 115 perpendicular to end of base 110.

If the regulation means 140 can be configured to regulate auto-rotation of the rotating plate 115, any shape for the regulation means 140 is preferable. In accordance with exemplary embodiments, a pair of belt-shaped or stick-shaped rubber is formed and is placed to the position as described above.

The auto-rotation of the rotating plate 115 is regulated by composing the regulation means 140 such as rubber, and thus the rotating plate 115 swings while rotating on the rotating shaft of the drive motor 111.

As another configuration of the regulation means 140, one end of rubber formed into a cylinder-shaped or truncated cone is connected to the base 110 and can connect the other end of the rubber to the above rotating plate 121. As shown in FIG. 2, a soleplate (corresponding to the playgame base 211) of the playgame member 210 imitating yachts is fixed to the rotating plate 115 of the rotary device 100 configured as above. In the present embodiment, the rotating plate 115 and playgame base 211 are fixed using well-known bolts 221 and nuts 222. In the case of playgame member 210 (e.g., playgame member 210 imitating a yacht and windsurfing of FIG. 2) comprising strut 212, it is desirable a rib 225 is provided on the lower part of the strut 212, for assisting the strut 212.

As for the playgame member 210 fixed to the rotary device 100 of the present invention, any shape is preferable. All playgame members 210 such as a jungle gym, the tree (a playground equipment imitating a tree and configured to be able to climb the tree) can be turned with the rotary device 100 besides a yacht and a surfing.

Detailed Description of the Preferred Embodiment 2

As noted in the detailed description of the preferred embodiment 1, a rotating plate 115 is attached to one end of the crank 112 (the other end is attached to rotating shaft of drive motor 111). In contrast, in preferred embodiment 2, the rotating plate 115 will be attached to one end of the crank 112, with the rotating plate 115 inclined.

Figure 3:
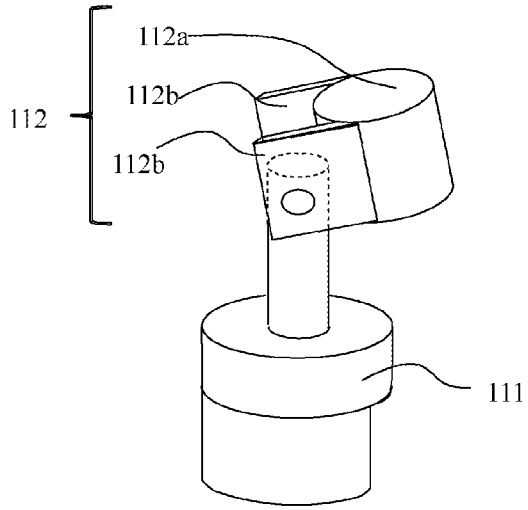
FIG. 3 is a perspective view and side elevation view illustrating an example of a rotating amusement apparatus having a rotary device in accordance with an embodiment of the present invention.
Figure 3:
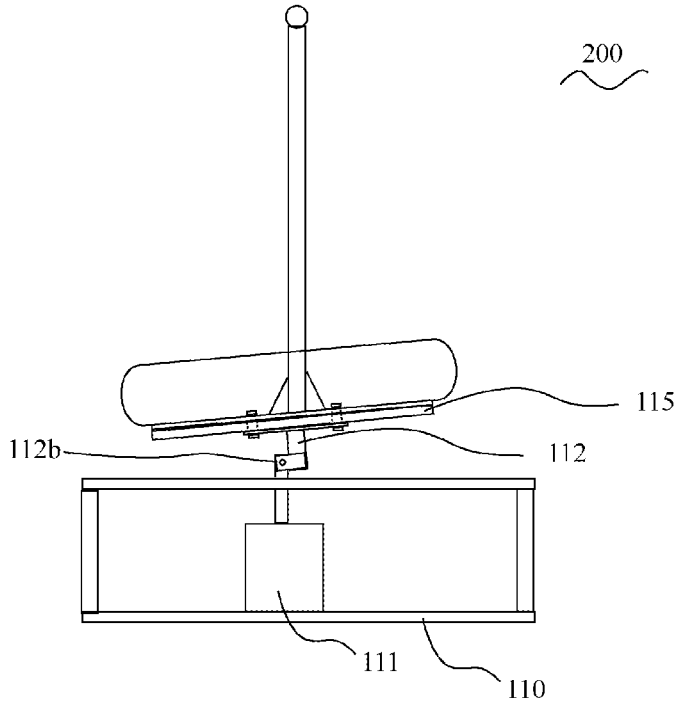

As shown in FIG. 3 (A), a support 112*a* enabling the rotating plate to be horizontally supported is formed. If the rotating plate 115 can be horizontally supported to the upper part or side of the support 112*a*, any shape is preferable. For example, the support 112*a* can be shaped as a column, a square pole, or a triangle pole. In the present embodiment, the rotating plate 115 is horizontally put on a top of the support 112*a* formed cylindrically.

The support 112*a* with a part putting the rotating plate 115 inclined against a horizontal-plane is fixed to the rotating shaft of the drive motor 111. In the present embodiment, the support 112*a* is fixed to the rotating shaft of the drive motor 111 via a fixture 112*b* attached on the side of the support 112*a*, for fixing the inclined support 112*a*.

The support 112*a* and the fixture 112*b* correspond to the crank 112 of the preferred embodiment 1. In supporting the rotating plate 115 at the sides of the support 112*a*, the support 112*a* is fixed to the rotating shaft of the drive motor 111 while the sides of the support are inclined against a horizontal-plane. Also wheels 130 described in the detailed description of the preferred embodiment 1 may be put on lower part of the rotating plate 115. In this embodiment, the rotating plate 115 is inclined against a horizontal-plane, thus the height from the lower parts of the rotating plate 115 to a floor may be varied according to a position of the rotating plate 115. Therefore, it is desirable that the height from the under surface of the rotating plate 115 to the wheel 130 is adjusted by attaching the wheel 130 to the rotating plate 115 via a height adjusting means 131 of the detailed description of the preferred embodiment 1. In the case of the present embodiment, a regulation means 140 for regulating the auto-rotation of the rotating plate 115 may be provided.

Also by applying a gum resin to the surface of a shock absorber coating an exterior frame of the rotating amusement apparatus 200, the shock absorber having a water repellency on its surface can coat the exterior frame.

Detailed Description of the Preferred Embodiment 3

In the preferred embodiment 1, the playgame base 211 (soleplate) of the playgame member 120 is fixed to the rotating plate 115. In contrast, the rotating plate 115 can be hung from an upper part.

Figure 4:
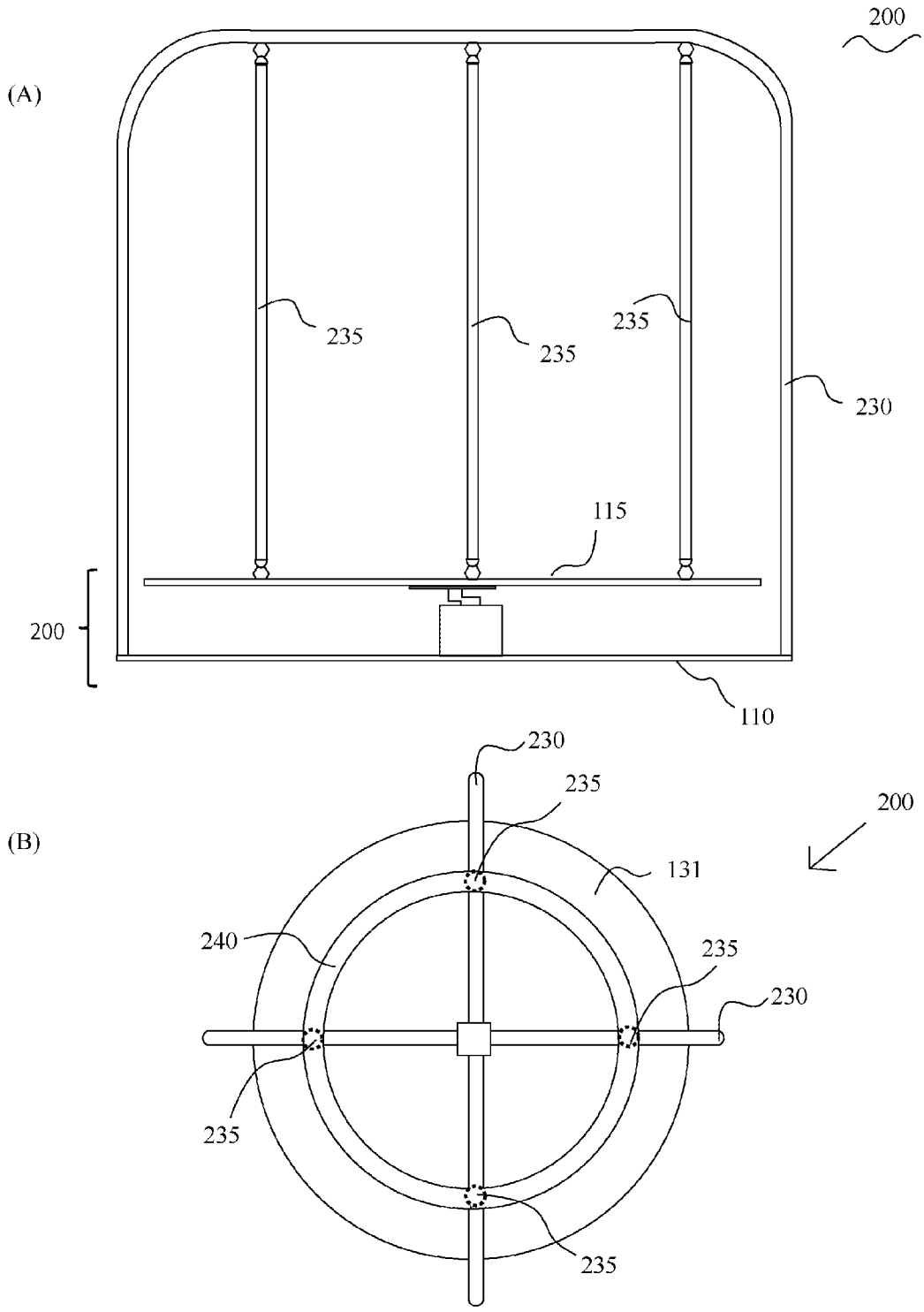
FIG. 4 is a front elevation view and top view illustrating an example of a rotating amusement apparatus having a rotary device in accordance with an embodiment of the present invention.

As shown in FIG. 4 (A), inverted "U-shaped" frame 230 is continuously integrally formed. Of course, the frame 230 may be formed by combining a plurality of frames. Then the frame 230 is vertically arranged to both ends of the base 110 (the base 110 supporting a motor) extending forward and backward. One end of a hung member such as the wire is connected to a symmetric position of the upper part of the frame 230, and the other end is connected to the rotating plate 115 under the frame. That is to say, the rotating plate 115 is connected to the base 110 via the drive motor 111 and the crank 112, and is hung from the upper part by the hung member 235.

The hung member 235 can hang the rotating plate 115 as follows. As shown in FIG. 4 (B), a pair of frames 230 is vertically arranged to an edge of the base 110 so as to intersect each other. And, hung members 235 can be connected to symmetric positions to each other, along a periphery of a ring 240 placed above the frame 230. The other end of the hung members 235 are connected to the rotating plate 115.

A drive motor 111 described in the detailed description of the preferred embodiment 1 is placed under the rotating plate 115. Crank 112 is attached to the rotating shaft of the drive motor 111, and the rotating plate 115 is fixed to the other end of the crank 112. Also the base 110 and the rotating plate 115 may be connected by the regulation means 140 described in the detailed description of the preferred embodiment 1. In this embodiment, wheels are not necessary.

When the rotating shaft of the drive motor 111 rotates by operation of the drive motor 111, the crank 112 makes eccentric rotation. Also in the present embodiment, the rotating plate 115 connected to the wire rotates when the wire hung by member 235 is swung by a user.

Figure 5:
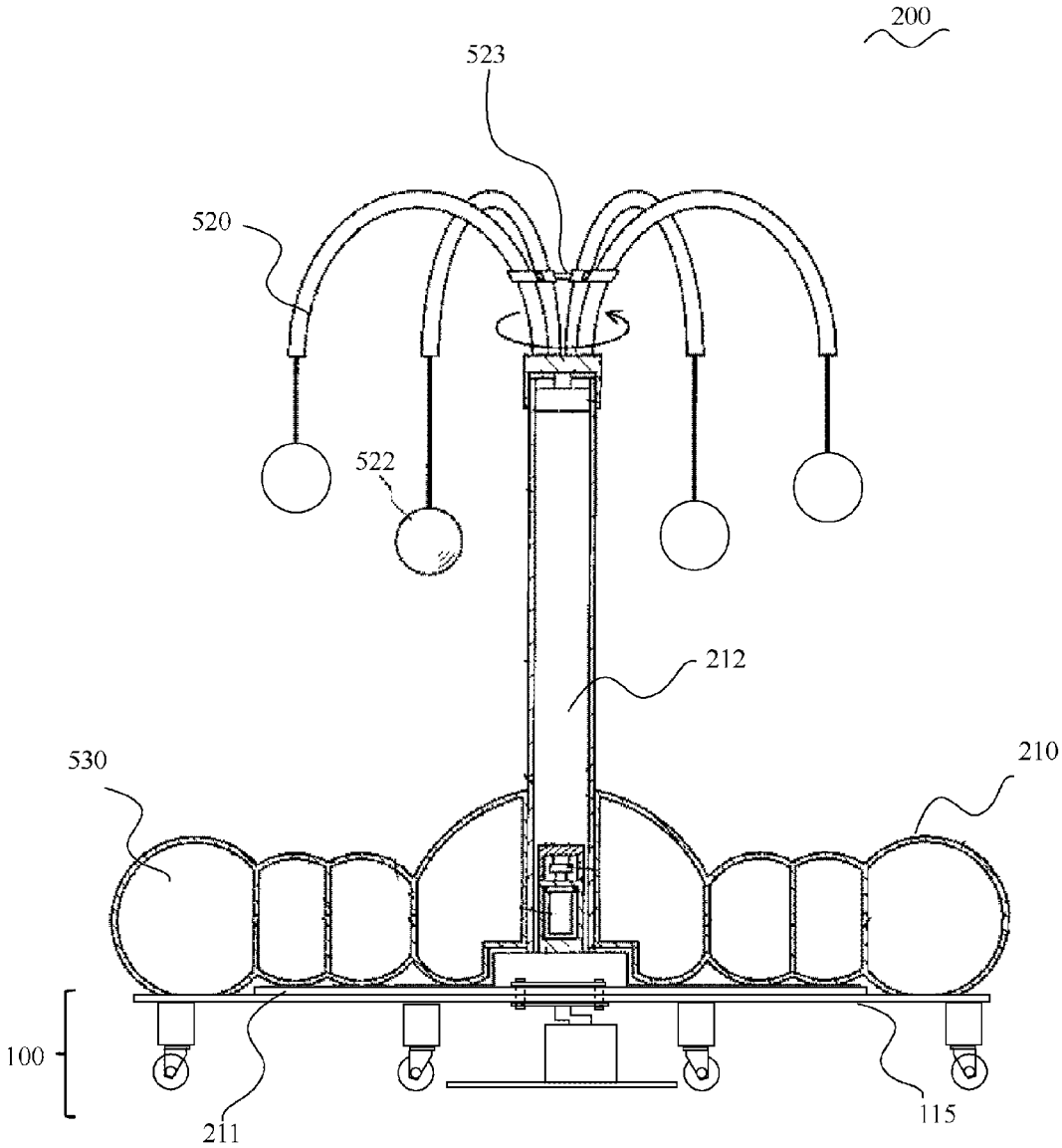
FIG. 5 is a front elevation view illustrating an example of a rotating amusement apparatus having a rotary device in accordance with an embodiment of the present invention.

Also by applying a gum resin to the surface of a shock absorber coating an exterior frame of the rotating amusement apparatus 200, the shock absorber having water repellency on its surface can coat the exterior frame. Another configuration of playgame member 210 is shown in FIG. 5. The playgame member 210 is provided with a strut 212 (corresponding to a support base) vertically arranged on a playgame base 211, and with a holding member 522 (the members having a shape enabling a user to hold) hung from the upper end of the strut 212 via a support arm 520.

In the present embodiment, when a motor (different from the drive motor 111 provided to the rotary device 100) provided to a hollow portion of the strut 212 formed using a hollow pipe rotates, the strut 212 rotates. Also each end of a plural of the support arms 520 is connected on the top surface of the strut 212. Each support arm 520 is radially arranged at equal intervals in the circumferential direction from a center axis of the strut 212. A position near one end of each support arm 520 is bundled by a fixing member 523.

The holding members 522 connected to the support arms 520 are placed at specified intervals from the outer peripheral surface of the strut 212. And when the strut 212 rotates (meaning a rotation by operation of the motor in the strut 212), the holding members 522 rotate. For example, holding members 522 are formed in a spherical shape, a ring, or a column shape, and a user can hold onto and hang on an outer peripheral surface of the holding member 522, and an annular inner peripheral surface of the holding member 522.

An air cushion may be placed in the perimeter of the strut 212. Even if a user falls off a holding member 522 by mistake, the air cushion reduce the user's impact, and a user's injures can be prevented effectively. The air cushion can be configured from a seat member having a flexibility. When the air cushion swells as a result of charging of the air by blowers, a hemispherical portion is formed in the center part, and three different-sized annular sections may be formed therearound. A playgame base 211 of the playgame member 210 is placed on the top surface of the rotating plate 115 of the rotary device 100 while the outermost of the annular portion is protruded from the outside.

Figure 6:
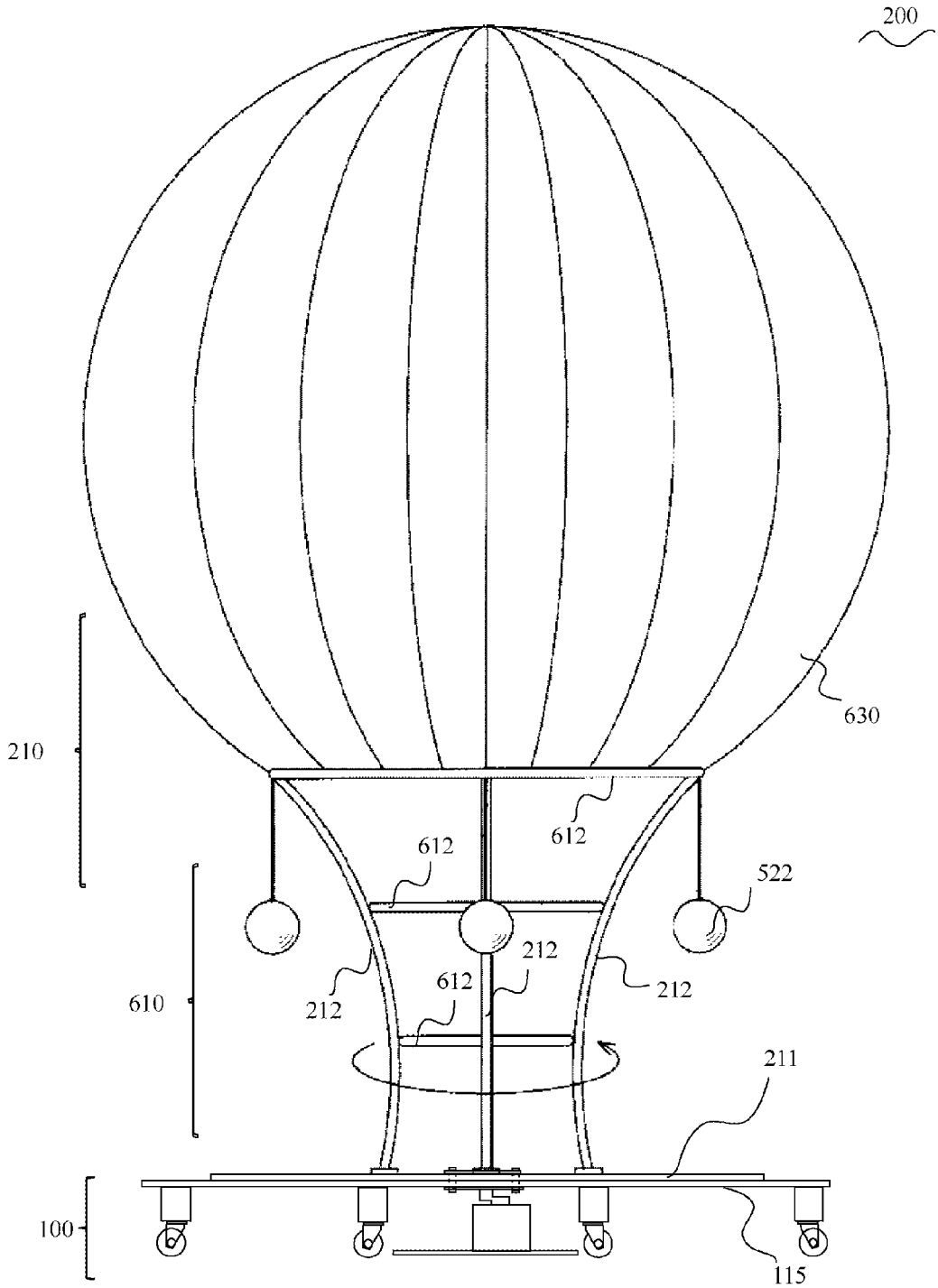
FIG. 6 is a front elevation view illustrating an example of a rotating amusement apparatus having a rotary device in accordance with an embodiment of the present invention.

Another playgame member 210 is shown in FIG. 6. This rotating amusement apparatus 200 is configured to place the playgame member 210 imitating a balloon on the playgame base 211. A holding member 522 is hung from a balloon support base 610 for supporting a balloon body 630 placed on the top face of the playgame base 211 via ropes. The holding member 522 is placed in the center axis circumference of the balloon body 630, and turns by a rotation of rotating amusement apparatus 200.

If balloon body 630 can be supported, the balloon support base 610 can be any shape. However in the present embodiment, a plurality of struts 212 are placed at equal intervals in the circumferential direction from the playgame base 211 (as shown in FIG. 6, shape warping the upper portion of the strut 212 outward). Each strut 212 is fixed by a ring-shaped member 612. In FIG. 6, each strut 212 is fixed in three places of an upper portion, an intermediate portion, and a lower portion. The ring-shaped member 612 placed in the upper portion of the struts 212 supports directly the balloon body 630.

Figure 7:
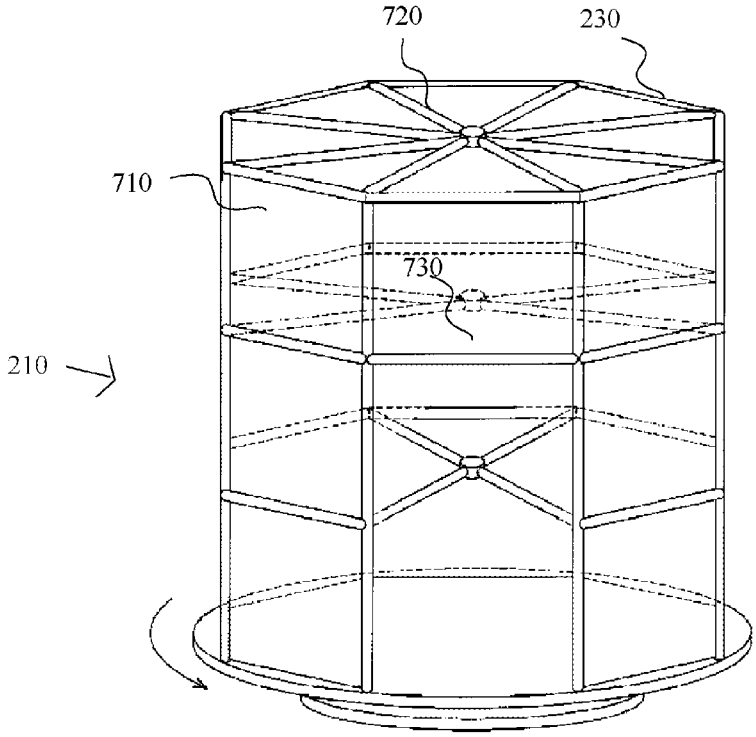
FIG. 7 is a perspective view and front elevation view illustrating an example of a rotating amusement apparatus having a rotary device in accordance with an embodiment of the present invention.
Figure 7:
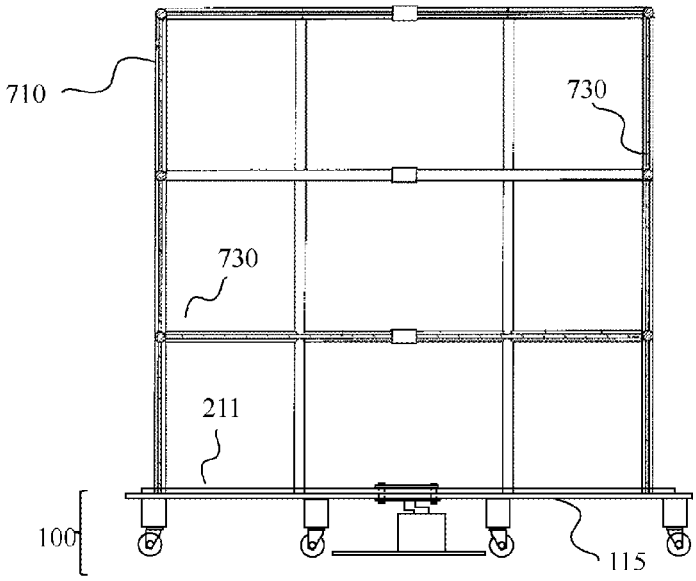

Another configuration of playgame member 210 is shown in FIG. 7. A frame 230 of an octagon shape is formed so that a plurality of rod members are vertically and horizontally combined. A partitioning member 710 is provided to the outside of the frame 230. The partitioning member 710 comprises a sheet having a flexibility, and is beamed between each member configuring the frame 230, and a decoration for attracting a user's attention (not shown) is ornamented to the outer surface thereof attracting a user's attention. In addition, an opening for communicating between the partitioning member 710 and the outside space and for enabling a user to go in and out may be formed.

A beam 720 is placed horizontally to the frame 230, and a floor member 730 is fixed between the adjacent beams. Each floor member 730 comprises a sheet member having a flexibility, and partitions a game region in upper and lower directions into three spaces. In addition, by providing a predetermined number of the communication portions vertically communicating adjoining spaces with each other, the top and middle spaces communicate with each other, and the middle and bottom spaces communicate with each other, so that a user can move within the playgame member 210.

The user can play like in a jungle gym, by moving laterally along the beam, moving laterally over the floor member 730, and moving vertically through the communication portion.

Detailed Description of the Preferred Embodiment 4

Figure 8:
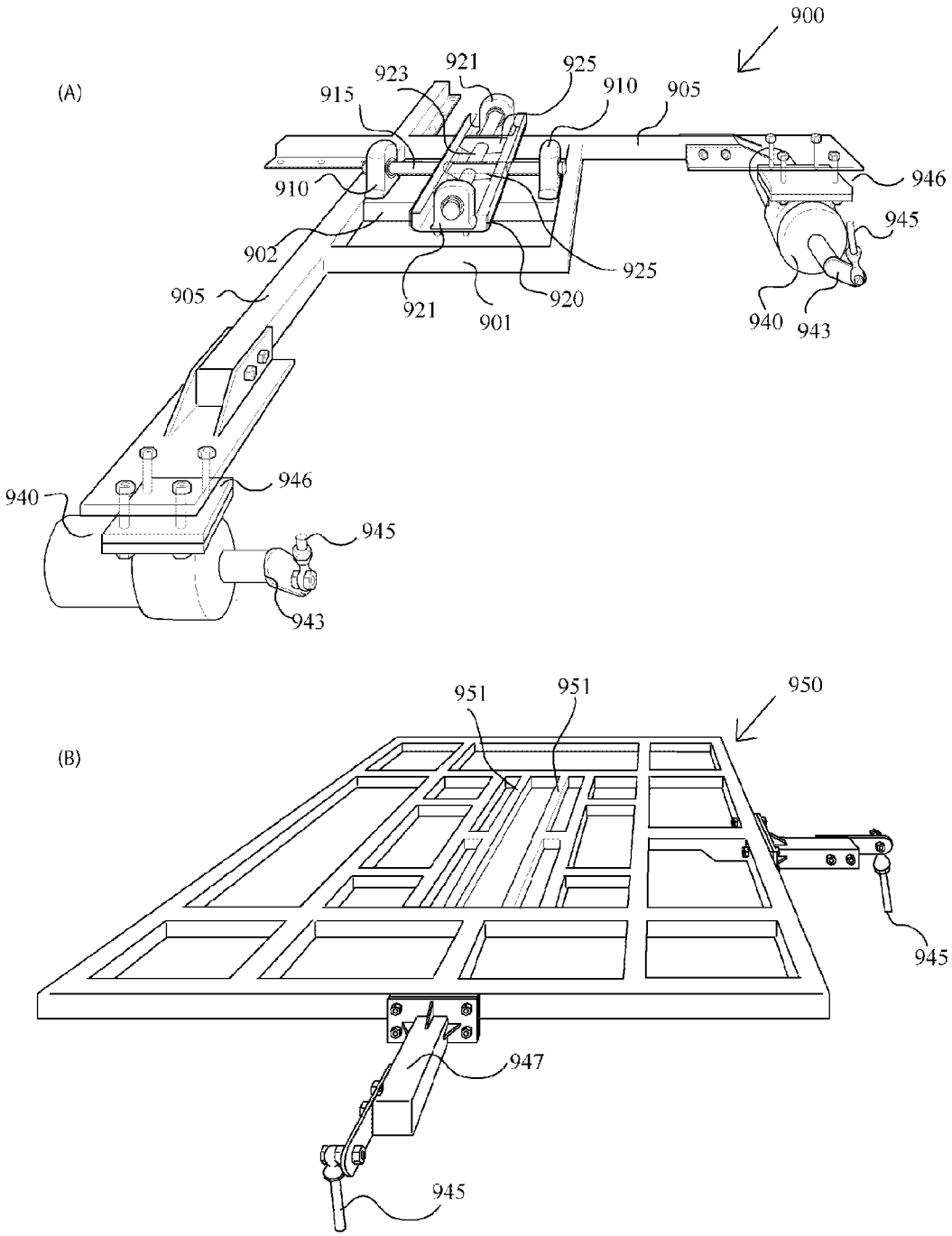
FIG. 8 it is a perspective view showing an example of the drive mechanism of a swing apparatus in accordance with an embodiment of the present invention.

A swing apparatus for swinging the playgame member can be placed on the rotating plate 115. FIG. 8 is a schematic view of a swing apparatus. As shown in FIG. 8, a swing apparatus of the present embodiment comprises a lower part frame 900 and an upper part frame 950.

The lower part frame 900 has a shape extending perpendicularly along two sides of a rectangular frame. A crosspiece 902 capable of supporting after-mentioned lower bearings 910 is connected to the rectangular portion 901 of the lower part frame 900. A pair of lower bearings 910 is placed near both ends of the crosspiece 902 coupled to the rectangular portion 901 of the lower part frame 900. Also a lower shaft 915 (corresponding to the lower rotating shaft) pivotally supported to the lower bearings 910 penetrates through an opening formed on both sides of the upwardly opened swing member 920 having a U-shaped cross-section. The lower shaft 915 is fixed while penetrating the swing member 920.

Therefore, when the lower shaft 915 performs specified angular rotation, swing member 920 swings through an angle corresponding to the rotation.

As described above, furthermore a pair of bearings (upper bearing 921) is placed on the swing member 920 swung by a rotation of the lower shaft 915 pivotally supported by the lower bearings 910. The pair of upper bearings 921 is placed in the longitudinal direction near both ends of the swing member 920 pointed to the orientation substantially orthogonally intersected to the lower shaft 915. A swing plate 925 is fixed to the upper shaft 923 (corresponding to the upper rotating shaft) pivotally supported to the upper bearings 921. Therefore, when the upper shaft 923 performs specified angular rotation, the swing plate 925 swings through the angle corresponding to the rotation. And the swing plate 925 is fixed to the upper frame 950.

Then a swinging motor 940 for swinging the upper frame 950 fixed by the swing plate 925 is fixed. The swinging motor 940 is attached to one end of an extended part 905 of the rectangular portion 901 of the lower part. A rotating plate 115 of rotary device 100 is fit in clearance 946 formed to the extended part 905 of the lower frame 900.

When the swinging motor 940 is active, a swing shaft 945 attached to the swinging motor 940 repeats swinging up and down by attaching a crank mechanism 943 to the rotating shaft of the swinging motor 940. The swing shaft 945 is configured to move up and down the upper frame 950 via the fixing member 947. A pair of swinging motor 940 is provided to the two edges of the two sides extending the lower frame 900, so that when the swing shaft 945 performs a swing up and down by active swinging motor 940, the upper frame 950 swings in response to it. A mechanism which the upper frame 950 moves back and forth and around, can be configured by controlling a rotary (frequency) timing of both swinging motors 940.

Figure 10:
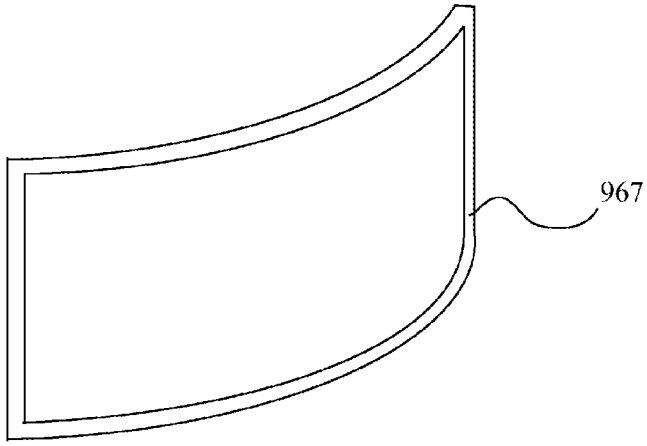
FIG. 10 is a top view and perspective view illustrating an example of a projection apparatus placed on a rotary device in accordance with an embodiment of the present invention.
Figure 10:
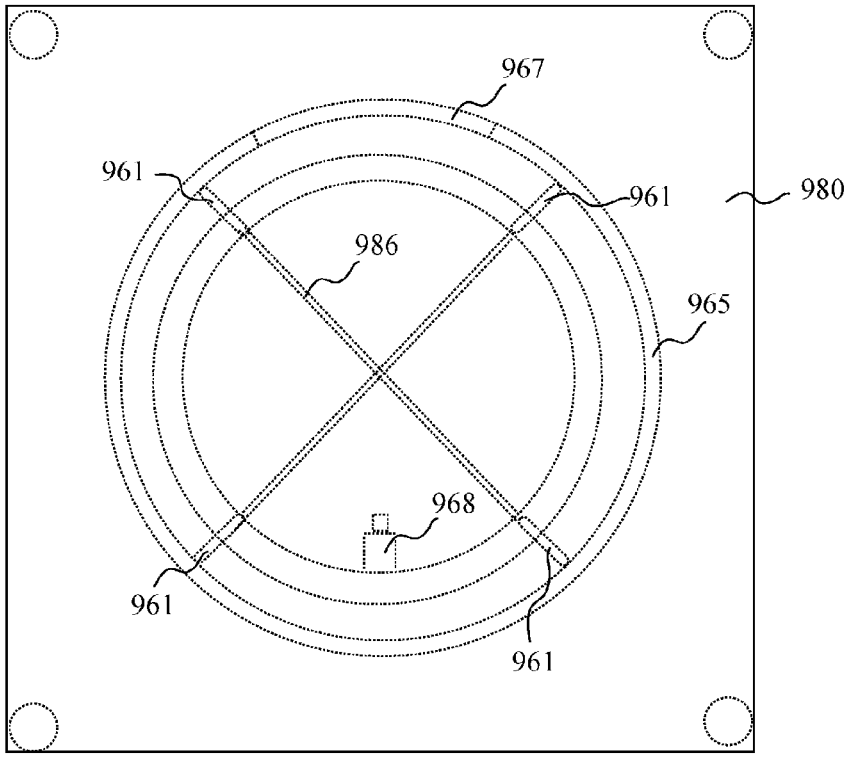

A playground equipment making eccentric rotation, while swinging, can be configured, by placing the swing apparatus configured as above to the rotary device 100 described with detailed description of the preferred embodiment 1. The following is a playground equipment comprising upper frame 950 of the swing apparatus. A projection apparatus 960 is attached above the playgame base 211 fixed to the rotating plate. For example, a projection frame 967 in a screen is hung from a circular ring 965 fixed to a plurality of leg sections 960. In accordance with exemplary embodiments, as shown in FIG. 10 (A), (B), top view shape of the projection frame 967 is formed in substantially the same shape of circular arc of the circular ring 965. As shown in FIG. 10 (B), projector 968 is provided in the position opposed to the projection frame 967 on the circular ring 965.

Figure 9:
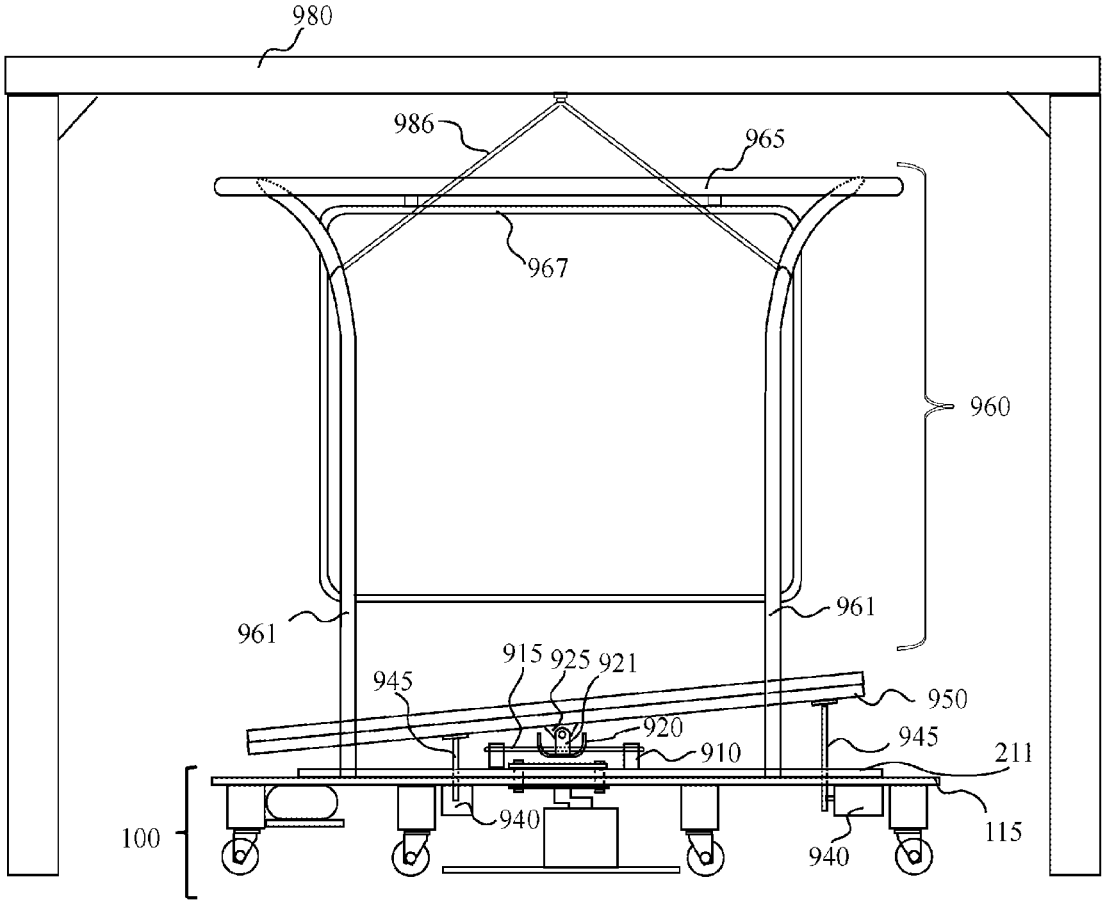
FIG. 9 is a front elevation view illustrating an example of the rotating amusement apparatus having a rotary device in accordance with an embodiment of the present invention.

The rotating plate 115 is hung from the upper part. The projection apparatus 960 is hung from the higher position (e.g., pedestal 980 shown in FIG. 9) than height placed to the rotary device 100 by using the chain 986 or other material.

INDUSTRIAL APPLICABILITY

The present invention can make eccentric rotating the playground equipment by attaching a crank mechanism to the rotating shaft of the swinging motor. In accordance with an aspect of the present invention, a rotating amusement apparatus can do complicated movement so that the rotating plate swings on the rotating shaft of drive motor 111 and so that the rotating plate swings on the position fixed to the crank. Also autorotation of the rotating plate can be stopped by the regulation means. It can make complicated swing operation without the complicated mechanism such as control panels, and a playground equipment with excellent ability of maintenance can be provided. Therefore, the industrial applicability is provided.

The embodiments and implementations that have been disclosed here are illustrative by nature and should not be regarded as limiting. The scope of the invention is defined by its claims rather than the foregoing description, and should be understood to include the features of the claims of the invention and equivalents thereof, in addition to all changes falling within the scope of the claims.

What is claimed is:

1. A rotating amusement apparatus comprising a rotary device comprising:

a drive motor placed on a base;

a crank coupled to a rotating shaft of the drive motor, the crank comprising one end that rotates with the rotating shaft and another end that is offset from and parallel to the rotating shaft that makes eccentric rotation around the rotating shaft;

a rotating plate fixed to the other end of the crank;

a playgame member fixed to the rotating plate of the rotary device and located above the crank; and the playgame member rotating together with the rotating plate, by eccentric rotation.

2. A rotating amusement apparatus comprising a rotary device comprising:

a drive motor placed on a base;

a support supporting a rotating plate, wherein the support is located below the plate, a fixture pivotally supporting the support to a rotating shaft rotated by the drive motor, the support by being pivotally supported to the rotating shaft is inclined against a horizontal-plane, such that the rotating plate is inclined against the horizontal-plane;

a playgame member fixed to the rotating plate of the rotary device; and the playgame member rotating together with the rotating plate, by eccentric rotation.

3. The rotating amusement apparatus according to claim 1, further comprising a substantially reverse U-shaped frame vertically arranged on the base of the rotary device, and the rotating plate of the rotary device is hung by the frame.

4. The rotating amusement apparatus according to claim 1, further comprising a shock absorber coated on a part of the playgame member, and a gum resin applied to a surface of the shock absorber.

5. The rotating amusement apparatus according to claim 4, wherein the shock absorber is urethane.

6. The rotating amusement apparatus according to claim 1, further comprising a wheel placed on the rotating plate.

7. The rotating amusement apparatus according to claim 1, further comprising a regulation means placed between the base of the rotary device and the rotating plate, for regulating an auto-rotation of the rotating plate.

8. The rotating amusement apparatus according to claim 1, wherein the playgame member comprises a support base placed on an upper part of the rotating plate, a plurality of holding members hung from the support base and being turned by the rotation of the rotating plate.

9. The rotating amusement apparatus according to claim 1, wherein the playgame member comprises:

a frame placed on the rotating plate, for forming a game region for a user, partitioned off from external space;

a floor member comprising one or a plurality of members dividing the game region into at least two vertically adjoining spaces;

the floor member forms a communication portion communicating with the spaces.

10. The rotating amusement apparatus according to claim 1, further comprising:

a swing apparatus placed on the rotating plate, the swing apparatus comprising:

a lower rotating shaft rotatably provided in a lower frame;

a swing member fixed to the lower rotating shaft;

an upper rotating shaft rotatably provided in the swing member, in a direction perpendicular to the lower rotating shaft;

a swing plate fixed to the upper rotating shaft;

an upper frame fixed on the swing plate;

a motor capable of swinging up and down the upper frame.

11. The rotating amusement apparatus according to claim 2, wherein a shaft of said drive motor is located directly under said plate.

* * * * *